US007984572B2

(12) United States Patent
Gallay

(10) Patent No.: US 7,984,572 B2
(45) Date of Patent: Jul. 26, 2011

(54) SNOW SHOES OF THE TYPE WHOSE WEBBING INCLUDES A STRETCHED FABRIC IN THE INTERIOR OF A FRAME

(75) Inventor: Philippe Gallay, La Clusaz (FR)

(73) Assignee: TSL Sport Equipment, Alex (FR)

( * ) Notice: Subject to any disclaimer, the term of this patent is extended or adjusted under 35 U.S.C. 154(b) by 1134 days.

(21) Appl. No.: 11/652,875

(22) Filed: Jan. 12, 2007

(65) Prior Publication Data

US 2007/0251127 A1 Nov. 1, 2007

(30) Foreign Application Priority Data

Jan. 13, 2006 (FR) ..... 06 00328

(51) Int. Cl.
*A43B 5/04* (2006.01)
*A43B 5/16* (2006.01)

(52) U.S. Cl. ..... 36/122; 36/124; 36/125

(58) Field of Classification Search ..... 36/122–125, 36/7.6, 7.7; 24/265 C; 248/74.1–74.3
See application file for complete search history.

(56) References Cited

U.S. PATENT DOCUMENTS

| | | | | | |
|---|---|---|---|---|---|
| 735,290 | A * | 8/1903 | Phelps | 36/122 |
| 1,052,139 | A * | 2/1913 | Emack | 36/122 |
| 3,175,269 | A * | 3/1965 | Raduns et al. | 24/265 C |
| 3,906,592 | A * | 9/1975 | Sakasegawa et al. | 248/68.1 |
| 4,271,609 | A | 6/1981 | Merrifield | |
| 5,377,940 | A * | 1/1995 | Cabe et al. | 248/74.3 |
| 5,440,827 | A | 8/1995 | Klebahn et al. | |
| 5,517,772 | A | 5/1996 | Anderson | |
| 6,363,628 | B1 | 4/2002 | Mahon et al. | 36/122 |
| 6,398,170 | B1 * | 6/2002 | Wada | 248/74.5 |
| 6,732,982 | B1 * | 5/2004 | Messinger | 248/74.1 |
| 7,493,709 | B2 * | 2/2009 | Trask et al. | 36/122 |
| 2004/0250453 | A1 | 12/2004 | Settelmayer | 36/122 |

* cited by examiner

*Primary Examiner* — Jila M Mohandesi
*Assistant Examiner* — Melissa L Lalli
(74) *Attorney, Agent, or Firm* — Fay Sharpe LLP

(57) ABSTRACT

A snowshoe (1) whose webbing includes a flexible wall (4) maintained in tension inside a framework (2) by portions of the flexible mounting wall which define flexible mounting projections. Supplemental protection parts (8) are disposed surrounding the mounting projections to protect them from wear and impact.

8 Claims, 4 Drawing Sheets

SNOW SHOES OF THE TYPE WHOSE WEBBING INCLUDES A STRETCHED FABRIC IN THE INTERIOR OF A FRAME

BACKGROUND

The present invention relates to a snowshoe and more particularly an improvement for snowshoes of the type whose webbing includes a fabric ensuring the support on snow. It more particularly relates to the mounting of the fabric constituting the webbing, on the framework.

The snowshoes, devices known for very many years, have been used for several centuries by the Scandinavian populations to move on snow. Until recently, snowshoes were used by ordinary travelers or soldiers to allow the populations and the alpine troops to move on snow for the movements required by the everyday life. Currently, snowshoes are instead used by walkers or sportsmen who undertake excursions and walks, and even competitions. But the sportsmen, although participating for their pleasure, are increasingly demanding for the equipment which they use, and it is true that the currently sold products do not give whole satisfaction.

Many types of snowshoes are known and, in particular, the snowshoes of the type of those which one finds in Europe, are constructed of a webbing made out of plastic on which the boot is retained. Also known are snowshoes originating in North America which generally consist of a tubular framework supporting a tensioned fabric which constitutes the webbing. These snowshoes have many advantages and are generally relatively well adapted to the snow conditions which one meets in this area. However, it appears that these snowshoes present disadvantages related to their stability and their reliability, in particular with regard to the mounting of the fabric to the tubular framework.

Thus, snowshoes where the fabric is mounted directly around the tube forming the framework like those described in the U.S. Pat. No. 5,440,827 and U.S. Pat. No. 5,517,772, present problems of fast wear of the fabric at the level of the places where it is mounted to the tubular framework, wear on the lower face which is caused when walking as well as wear on the upper part and on the outer portion of the fabric surrounding the tube which is caused by the various impacts and in particular by the contact with the snowshoe carried by the other foot. Identical problems are also found when the fabric is not mounted directly around the tube but comprises holding rings surrounding the tube as illustrated in the U.S. Pat. No. 4,271,609.

SUMMARY

The present invention proposes to solve the above mentioned disadvantages using means which are simple, reliable and easy to implement. It has for its objective to allow an effective mounting of the fabric on the tubular framework and to avoid a premature wear of the fabric on the level of the places where it is mounted to the framework in particular.

Thus, the snowshoe according to the invention is of the type whose webbing includes a flexible wall maintained tensioned inside a framework by projecting portions of the flexible wall defining mounting feet, and is characterized in that supplemental protection parts are disposed at the level of the mounting wall portions, the aforementioned supplemental protection parts.

According to complementary characteristics, the framework which has an extended form, includes a tube which includes two side tubes sections connected in front by an extending front tube section extending from the side tubes and forming a spatula while the side tube sections are connected to the back by a rear tube section.

According to another characteristic, the flexible wall 4 which makes up the webbing has the overall general form of the interior of the framework and includes in the front a forward central hole in order to allow the passage of in front of the boot at the time of its swiveling.

Let us note that the flexible wall includes several mounting feet.

Note also that the supplemental protection parts have the overall form of a tubular portion, disposed around mounting feet, while they have the form of a non-closed tube portion, whose cylindrical wall portion defines the protection body, is extended by two walls with mounting ends which extend substantially tangentially, namely a upper mounting wall and a lower mounting wall, the two mounting walls including a hole intended to receive the mounting rivet.

According to the preferred embodiment of the invention, the flexible wall includes side legs backs, a front mounting foot and a rear mounting foot, while the rear side legs and the rear leg includes a supplemental protection part which covers them.

BRIEF DESCRIPTION OF THE DRAWINGS

Other characteristics and advantages of the invention will emerge from the description which will follow compared to the annexed drawings which are given only by way of non-restrictive examples.

FIG. 1 is a top view of the snowshoe according to the invention.

FIG. 2 represents a prospective view of the snowshoe.

FIG. 3 is a plan view of the fabric, before its mounting and installation on the framework.

FIG. 4 is a cross-sectional view taken on the level of mounting of the fabric.

FIGS. 5, 6, 7, 8 are views representing the supplemental protection part.

FIG. 5 being a side view,

FIG. 6 being a top view,

FIG. 7 being a view from below.

FIG. 8 being a view of an external edge.

DETAILED DESCRIPTION

Figure 1:
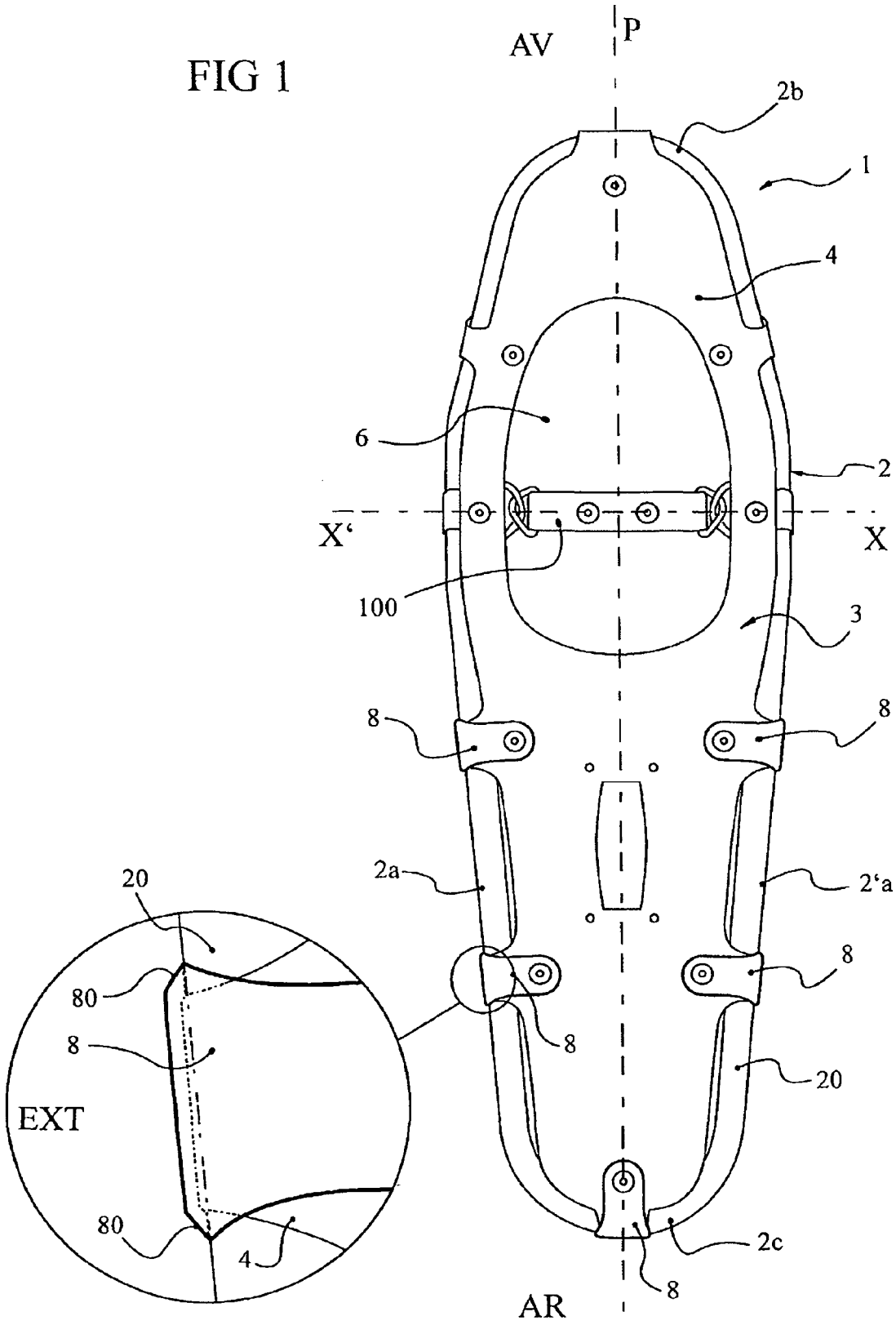
FIGS. 1 to 8 illustrate the preferred embodiment.
Figure 2:
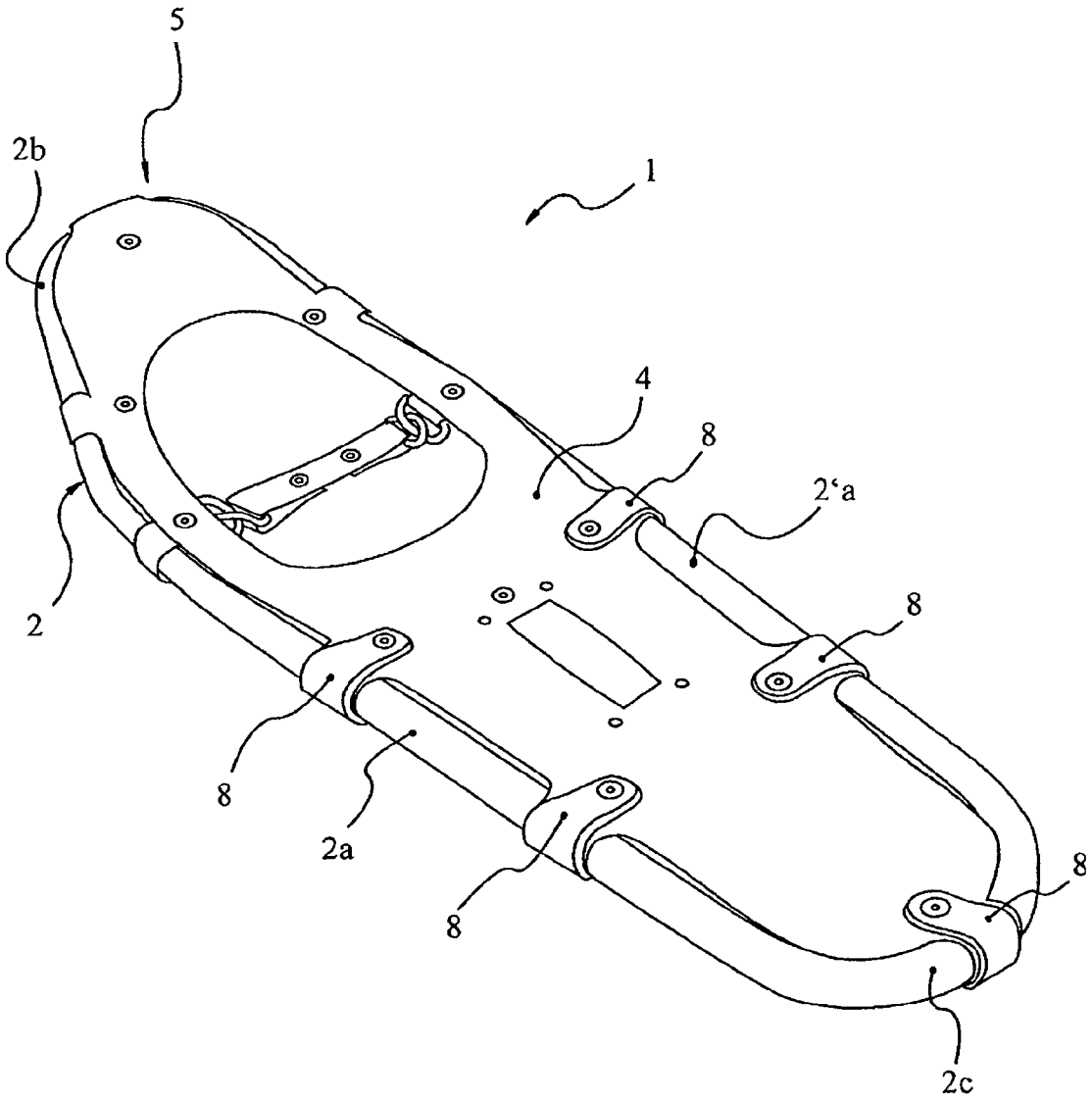
Figure 3:
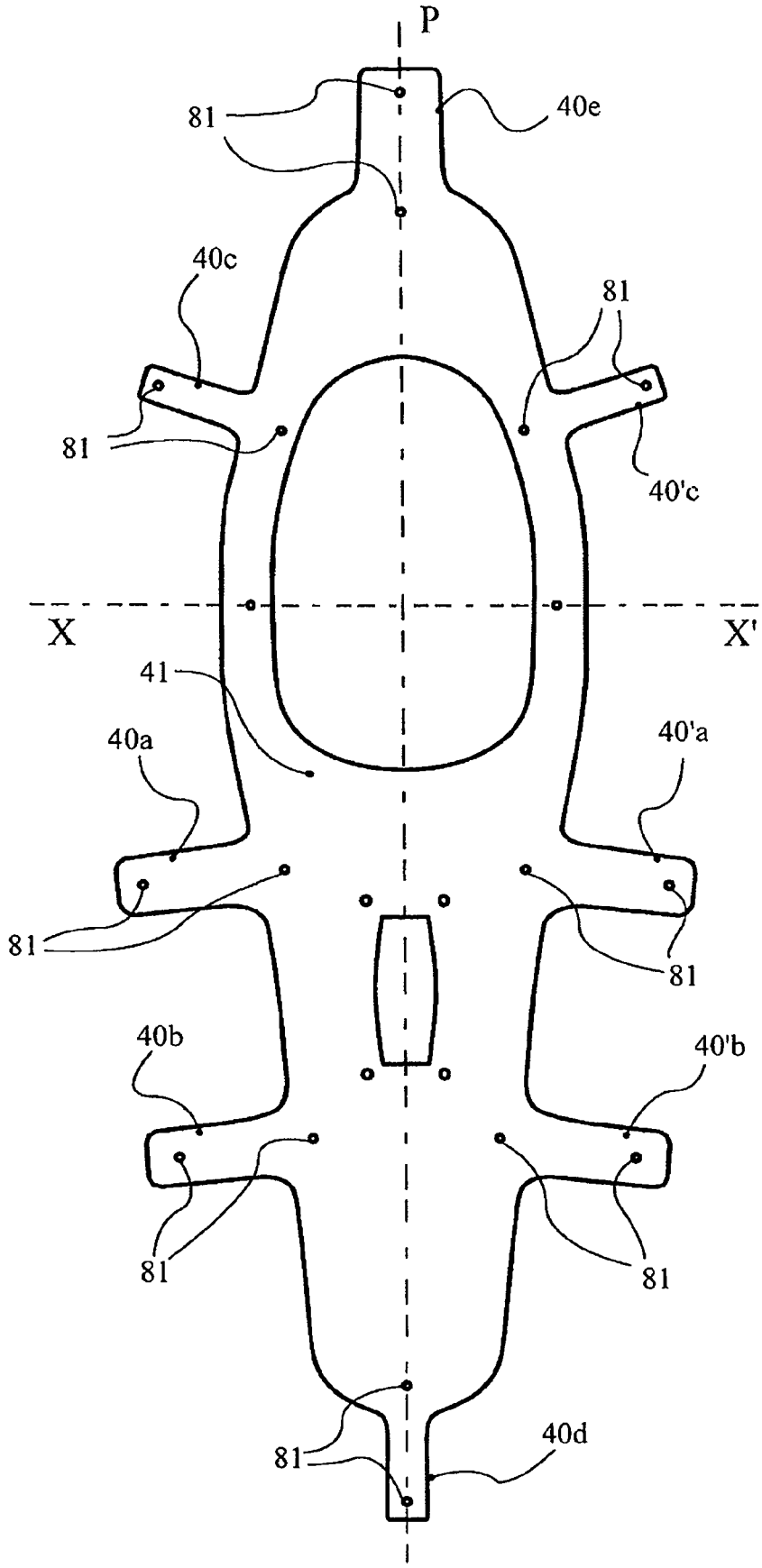

The snowshoe itself, carrying the general reference 1, includes a framework 2 which defines a boundary for a webbing 3 intended to receive the boot of the user, the aforementioned boot being retained on the webbing by a mounting which is not represented, but which is advantageously a hinged or the like plate mounted on the retaining cross-piece 100 and which is intended to swivel around the transverse axis X, X', the aforementioned hinged plate including means of front and rear retention, for the boot of the user.

The webbing 3 is at least partly defined by a flexible wall that we will call hereinafter the fabric 4 whose edge is intended to be mounted at the framework 2 in several places using mounting means. The aforementioned flexible wall, for example, is implemented with stretched plastic, or the like such as leather, or fabric of any kind.

The framework 2 is advantageously constructed of a peripheral metal tube 20, for example of aluminum or the like, such as steel or plastic or composite material. Of course one would not depart from the invention if the peripheral framework were not unitary or closed on itself. It is contemplated as well that the profile of the framework could have another cross-section than that of a cylindrical tube.

According to one embodiment of the snowshoe 1 according to the invention, it advantageously has a vertical longitudinal plane of general symmetry P. It also follows that the snowshoe could be not symmetrical without departing from the framework of the invention.

The peripheral tubular framework 2 has a lengthened form, and comprises two side tube sections 2*a*, 2'*a* connected at the front AV by a front tube portion 2*b* extending from the side tube sections and forming advantageously a raised spatula 5, while the side tube sections 2*a*, 2'*a* are connected at the back AR by a rear tube section 2*c*.

The fabric 4 which constitutes the webbing which has the overall general form of the interior of the framework 2 includes at the front a forward central hole 6 in order to allowing the passage of boot front at the time of its swiveling around the axis X, X'.

In addition, the fabric 4 is mounted to the tubular framework 2 at least in certain places, by projecting fabric portions 40*a*, 40*b*, 40*c*, 40'*a*, 40'*b*, 40'*c*, 40*d*, 40*e* constituting mounting feet. Thus, the fabric includes a central support zone 41 from which several mounting feet extend outward. In other words, the mounting feet (40 indicating the mounting feet collectively) are made of strips of fabric projecting from the fabric itself. These mounting feet 40*a*, 40*b*, 40*c*, 40'*a*, 40'*b*, 40'*c*, 40*d*, 40*e* are intended to surround the tube of the framework 2 on the top and outside, to be mounted there by a rivet 7 or the like.

Particularly, the fabric 4 includes four rear side legs 40*a*, 40*b*, 40'*a*, 40'*b*, two front legs 40*c*, 40'*c*, an extreme front leg 40*e*, and an extreme rear leg 40*d*.

The rear side legs 40*a*, 40*b*, 40'*a*, 40'*b*, are those located laterally, behind the pivot axis X, X', while the front legs 40*c*, 40'*c* are disposed at the level of the spatula 5, the end leg 40*e* on the front end of the spatula, while the rear leg 40*d* is at the rear end of the framework.

According to the invention, the snowshoe is such that it includes protection means, to protect the fabric on the level of the places where it is mounted to the tubular framework, and this at the places likely to be abraded such as wear on the lower face which is caused when walking as well as wear on the upper part and on the outer portion of the fabric surrounding the tube which is caused by the various impacts and in particular by the interaction with the snowshoe carried by the other foot.

Thus, the fabric 4 of the snowshoe according to the invention is protected by supplemental protection pieces 8 disposed at least at the level of the projecting side mounting feet 40*a*, 40*b*, 40'*a*, 40'*b*, and according to the illustrated embodiment on the level of the rear leg 40*d*.

Figure 4:
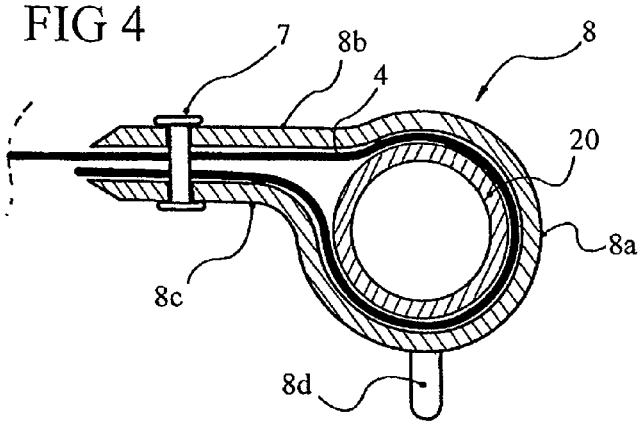
Figure 9:
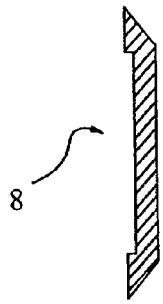
FIG. 9 is a sectional view according to 9-9 of FIG. 5.
Figure 5:
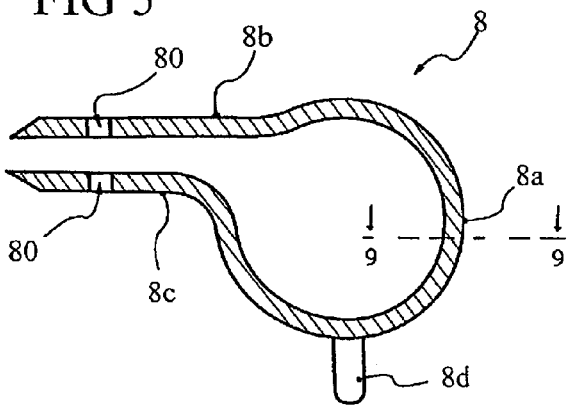
Figure 8:
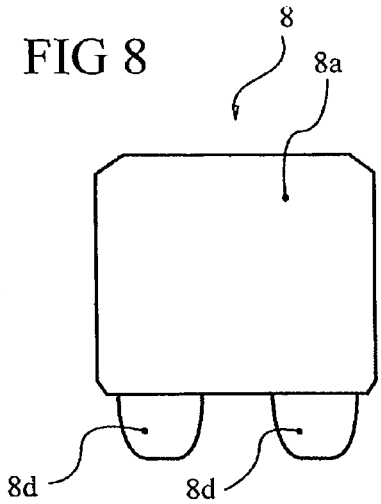
Figure 7:
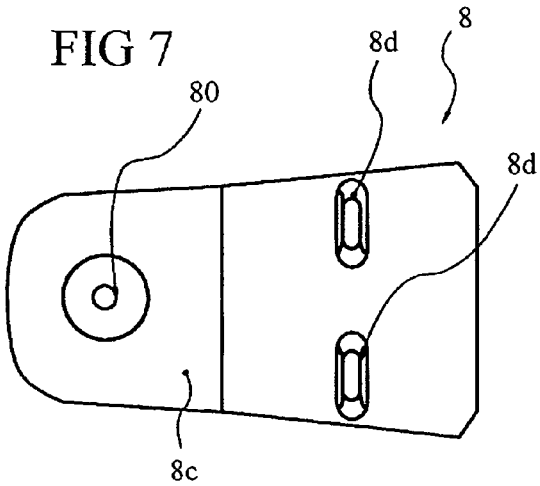
Figure 6:
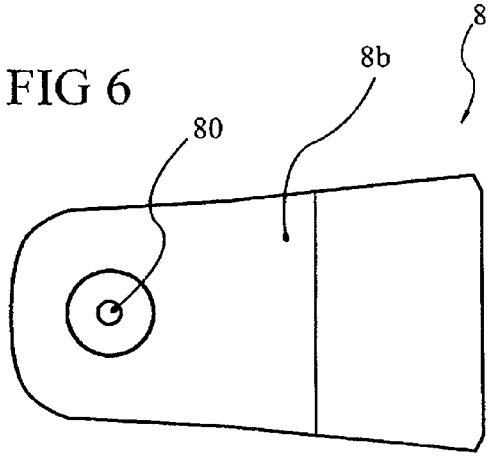

Let us add that the mounting feet 40 already extend above the tube 20 of the framework 2, pass around the aforesaid frame tube, and return towards the interior by passing under the aforementioned tube, such as shown more clearly in FIG. 4, and it is precisely to protect the part of the mounting feet which pass around the tube that the supplemental protection parts 8 are provided.

The protection means include supplemental protection parts 8 which are made out of a material potentially more durable than that of the fabric, such as for example out of injected plastic material, or out of softer material such as for example out of polyurethane. The supplemental protection parts 8 are intended to cover the mounting feet 40, in order to protect them, as stated previously.

These supplemental protection parts 8 have the overall form of a tubular section. According to the embodiment given by way of example, the supplemental parts 8 have the form of a open tubular section which is not closed, whose cylindrical wall portion 8*a* defines the protection body, is extended by two end mounting walls 8*b*, 8*c* which extend substantially tangentially. Thus, the supplemental protection parts 8 include an upper mounting wall 8*b* and a lower mounting wall 8*c*. It will be noted that the two mounting walls 8*b*, 8*c* include a hole 80 intended to receive the mounting rivet 7. Let us add that the lower part of the wall section 8*a* includes at least one projection 8*d* making it possible to improve the gripping qualities of the snowshoe.

Let us add that the protection parts 8 are such that they include at least in the external zone EXT of the cylindrical wall 8*a* chamfers 80 inhibiting a hard impact in the event of impacts by the other snowshoe.

Thanks to the supplemental protection parts 8 which cover the mounting feet 40 these last are retained on the framework by pinching or wedging between the framework tube and are thus completely protected.

The supplemental protection parts 8 protect the fabric on the level of its mountings to the framework, but also ensure and improves its retention with said framework, thanks to the rivet 7 which is engaged through holes 80 defined in the retention walls of the protection part and the corresponding holes 81 to be defined in the mounting feet of the fabric. Thus, the rivets which are firmly retained by the supplemental parts, and which are engaged in the holes 81 of the fabric ensure a full retention of the latter by avoiding possible tears.

It will be noted that the width of the supplemental protection parts are the same width advantageously as the width of the mounting feet of the fabric. But it could, of course, be of it different.

The peripheral framework 2, in the preferred embodiment, is of only one piece and is constructed of a continuously formed tube, but one would not depart from the framework of the invention, if it were constructed of several pieces or not only one or two sections.

Of course, the invention is not limited to the embodiment described and represented by way of example, but it includes also all the technical equivalents and their combinations

The invention claimed is:

1. A snowshoe comprising:

webbing including a flexible wall made of fabric, maintained in tension inside a peripheral framework by flexible mounting wall portions defining fabric mounting feet, said fabric mounting feet being configured to extend around the peripheral framework at least one a top and at sides;

supplemental protection parts disposed on a level of the fabric mounting feet;

wherein the supplemental protection parts each have a form of a non-closed tubular section, with a cylindrical wall portion defining a protection body from which an upper mounting wall and a lower mounting wall extend substantially tangentially;

the upper and lower mounting walls each including a hole for receiving a mounting rivet; and wherein a lower portion of the cylindrical wall portion includes at least one downward protection part projection to improve gripping qualities of the snowshoe, each supplemental protection part extending around one of the fabric mounting feet and the peripheral framework.

2. The snowshoe according to claim 1, wherein the framework has a lengthened form and includes a tube.

3. The snowshoe according to claim 2, wherein the peripheral framework includes two side tube sections connected at a front by a front tube section extending from the side tube sections and forming a spatula, the side tube sections being connected at a rear by a rear tube section.

4. The snowshoe according to claim 1, wherein the flexible wall has overall a general form of an interior of the peripheral framework and includes a front central hole toward a front portion to allow passage of a front of a boot when swiveling around an axis X, X'.

5. The snowshoe according to claim 4, wherein the flexible wall includes several mounting feet.

6. The snowshoe according to claim 2, wherein the flexible wall has overall a general form of an interior of the peripheral framework and includes a front central hole toward a front portion to allow passage of a front of a boot when swiveling around an axis X, X'.

7. The snowshoe according to claim 3, wherein the flexible wall has overall a general form of an interior of the peripheral framework and includes a front central hole toward a front portion to allow passage of a front of a boot when swiveling around an axis X, X'.

8. A snowshoe comprising:

a peripheral frame;

a flexible fabric wall held in tension on the peripheral frame by integral flexible fabric mounting extensions which fold around the peripheral frame;

a plurality of protection parts, each protection part including:

a non-closed tubular section which extends around one of the flexible fabric mounting extensions and the peripheral frame, a pair of mounting legs extending integrally from the non-closed tubular section, a first mounting leg of the pair extending above the flexible fabric wall and a second mounting leg of the pair extending below the flexible fabric wall;

a plurality of fasteners, each fastener extending through the flexible fabric wall and at least one of the mounting legs of one of the protection parts to hold the flexible fabric wall to the peripheral frame; and wherein the non-closed tubular section of at least one of the protection parts includes at least one downward projection to improve grip.

* * * * *